United States Patent [19]

Schoppe et al.

[11] 4,300,480

[45] Nov. 17, 1981

[54] APPARATUS AND PROCESS FOR THE OPERATION OF AN ENVIRONMENTALLY SATISFACTORY COAL FIRED PLANT

[76] Inventors: Fritz Schoppe, Max-Rüttgers-Str. 24, 8026 Ebenhausen, Isartal; Wilhelm Wenz, Ehlersstr. 19, 5142 Hückelhoven, both of Fed. Rep. of Germany

[21] Appl. No.: 103,461

[22] Filed: Dec. 14, 1979

[30] Foreign Application Priority Data

Dec. 15, 1978 [DE] Fed. Rep. of Germany ..... 2854170

[51] Int. Cl.[3] ..... F22B 9/06; F23D 11/44

[52] U.S. Cl. ..... 122/121; 110/347; 110/345; 431/9

[58] Field of Search ..... 431/8, 9; 110/347, 342, 110/345, 261; 122/121

[56] References Cited

U.S. PATENT DOCUMENTS

| | | | |
|---|---|---|---|
| 871,070 | 11/1907 | Schwartz | 431/9 |
| 2,800,175 | 7/1957 | Sharp | 431/9 |
| 3,955,909 | 5/1976 | Craig et al. | 110/345 |
| 4,000,978 | 1/1977 | Henrie | 431/9 |
| 4,057,021 | 11/1977 | Schoppe | 110/347 |
| 4,128,388 | 12/1978 | Freze | 431/9 |
| 4,223,615 | 9/1980 | Breen et al. | 110/347 |

*Primary Examiner*—Henry C. Yuen
*Attorney, Agent, or Firm*—Daniel M. Rosen

[57] ABSTRACT

The invention concerns a process for operating a coal-dust fired power plant in environmentally sound fashion and arrangements for accomplishment of the process pursuant to the invention. The same relates in particular to the reduction of the emission of gases harmful to the environment such as $NO_x$ and $SO_2$.

A particularly surface-active coal dust is used and is heated extremely rapidly in a burner muffle before being mixed with combustion air. After combustion the flame gases are very rapidly cooled down to a temperature under 1000° C. before being discharged from the burner muffle.

4 Claims, 4 Drawing Figures

APPARATUS AND PROCESS FOR THE OPERATION OF AN ENVIRONMENTALLY SATISFACTORY COAL FIRED PLANT

BACKGROUND OF THE INVENTION

The invention relates to a process for operating a coal-dust fired power plant in an environmentally satisfactory manner, and an apparatus for accomplishment of the process in accordance with the invention. The invention further relates in particular to the reduction of the emission of gases harmful to the environment such as $NO_x$ and $SO_2$.

It is an object of the invention to reduce the cost of construction of the boiler and in particular of the stack, as a result of which, in addition to saving on installation costs, it is possible to build power plants at locations where this has hitherto not been possible, for example, in congested areas, or where for reasons of flight safety the erection of a tall stack is not feasible.

It is a further object of the invention to reduce, entirely or in part, the cost of scrubbing for removal of the $SO_2$ from the stack gases.

Efforts in this direction are known. For example, in an early stage of development of vortex layer firing reduction of $NO_x$ emission was obtained by controlling the temperature of the vortex layer. Further, a portion of the $SO_2$ may be tied up by the addition of dolomite and similar products.

As opposed to this, it is possible by the process pursuant to the invention to reduce the emission of $NO_x$ even further than it is possible to do by vortex layer firing, and to tie up the $SO_2$ without having to use additives. These effects, rather, are obtained solely by suitable management of the process and design of the associated arrangement.

The invention represents an outgrowth of the discovery made by the inventors in small boiler firing, according to which under certain circumstances the $NO_x$ and $SO_2$ levels are successfully reduced by suitable process control without separate additives. The object of the invention is accomplished by using process and apparatus in accordance with the aforesaid discovery.

The inventive process will first be described in a general way and then explained with reference to examples.

The process begins with the use of coal dust as fuel, which allows the production of an extremely surfaceactive dust-like ash, where the ash is obtained dry and is removed in the form of dust. Thus the process is suitable not only for large power plants, which operate essentially without interruption, but also for industrial boilers which, for example, must be closed down for the weekend, without costly start-up and shut-down procedures having to be used. The first condition for keeping the firing chambers and convection heating surfaces clean is realized at the same time.

Such fuel is described, for example, in U.S. patent application Ser. No. 865,483, filed Dec. 29, 1977, and entitled "Process for Improving the Safety of Brown Coal Dust." This fuel consists, for example, of 70% to 80% brown coal dust of particle sizes of up to 0.3 mm, from which fibrous impurities are largely removed, and 20% to 30% particularly fresh finely ground anthracite dust having a particle-size range of preferably 5 to 10 microns, which is thoroughly mixed and kneaded with the brown coal dust, whereas the anthracite dust, because its surface polarity is opposite to that of the brown coal, coats the particles of brown coal with a mechanically tight-fitting fine layer, where remarkably stable agglomerates up to approximately 1 mm in size are formed. The fuel may thus be safely stored, transported and handled without the stringent safety measures customary with brown coal dust. It may likewise be conveyed and fluidized practically dust-free.

Because of the inerting and heat-insulating effect of the anthracite coating on the particles of brown coal, the latter do not ignite immediately upon injection into the firing chamber at the temperatures known for brown coal dust. Rather, this temperature must be exceeded considerably in order to overcome the insulating resistance of the anthracite.

Such superheating and its resultant effects may be considerably increased even further, pursuant to the invention, by carrying out the heating at a high rate, for example, at more than 1000° C./sec., preferably at more than 2000° C./sec. In this way superheating takes place more rapidly, as the volatile components are able to diffuse out of the brown coal structure in orderly fashion. In addition, the partial pressure of the volatiles rises so rapidly that an explosion-like rupturing of the coal particles is produced, leaving as residue a coke and ash skeleton of correspondingly fissured and torn structure, on the surface of which are found unsaturated free valences of high reactivity which combine readily with gaseous components, preferably with those of high reactivity. These include preferentially $SO_2$, $SO_3$ and $NO_x$ compounds in the initial period of their formation. The more rapid the rate at which the coal dust has been heated up, the stronger this effect will be.

In this connection, the rate of heating in the lower temperature range is much less important than that in the vicinity of and above the usual ignition temperature of brown coal. It is even favorable first to preheat the dust slowly up to temperatures below this range and with small temperature gradients in the dust particle, without producing noteworthy discharges of volatile components, and then to expose the dust to as rapid as possible a heating rate.

After heating and rupture of the coal dust the necessary combustion oxygen must be admixed and combustion terminated as quickly as possible. It is essential to the invention, in this connection, to complete combustion at the fastest possible rate and using the most intensive possible turbulence and to cool the combustion flue gases as quickly as possible down to below the temperatures which are hazardous for nitrogen compounds.

This is accomplished in accordance with the invention in that stabilization of the flame and intermixing of fuel and air is accomplished using rotating flow systems which internally have an extensive return flow consisting essentially of hot combustion gases. The coal dust is injected into this return flow and mixed with it, resulting in the aforementioned preheating of the coal dust. Further heating takes place due to the effect of the radiation of the flame enveloping the return flow. Owing to the rotation of the flow and the centrifugal force associated therewith, the coal dust moves toward the end of the return flow into the outer zones of flow, where it is mixed with the oxygen of the through-put flow and spontaneously ignites. Such flow patterns are generally described in U.S. Pat. No. 4,057,021, and are obtained in a tapered divergent burner muffle to which combustion air is supplied tangential to the inlet cross-section and which ends in a convergent accelerating nozzle for the flame jet.

Within certain described limits of combinations of dimensional ratios and angles of twist, there is obtained therein a flow effect producing a return flow which is somewhat longer than the length of the divergent burner muffle. This flow pattern provides the necessary conditions for slow preheating of the coal dust, the subsequent spontaneous rise in temperature and resulting heating rates pursuant to the invention. The latter are characterized by firing chamber loads of the said muffle of $5-15\times10^6$ kcal/m$^3$ hr at atmospheric pressure (at).

The flow pattern described likewise meets the conditions necessary for the rapid cooling of the flame gases, necessary on account of the $NO_x$ compounds, because the accelerating nozzle described, which is joined to the burner muffle, produces flame jet velocities of between 100 and 200 m/sec. A jet thrust of the order of magnitude of 100 Kp is thereby produced, and acts like an oversized injector on the gas content, already cooled, of the firing chamber. Intensive recirculation is thus produced in the same chamber, as a result of which a flow along the cooled firing chamber walls travels back against the impulse of the burner, which flow is convectively cooled, sucked up by the flame jet and mixed with the latter. It is contemplated that the flame jet is cooled by intermixture with cooled flame gases from the firing chamber in less than 0.1 sec., preferably less than 0.05 sec., to less than 1000° C. gas temperature, preferably to less than 900° C. gas temperature. Within about 0.02–0.04 sec., preferably less than 0.05 sec., the flame jet is thus cooled down to temperatures of under 900° C.

The flame jet velocity is obtained in that a higher pressure exists in the burner muffle than in the firing chamber; this pressure is then converted into velocity in proportion to the temperature of the flame jet.

The velocity energy of the flame jet is thereby obtained, predominantly from the combustion energy. As a result, a thermal engine process is involved, in which air is compressed to the pressure in the burner muffle and then heated by addition of fuel. In its subsequent expansion in the flame nozzle, mechanical energy is produced, appearing in the form of kinetic motion of the flame jet.

In addition, to the rapid cooling of the $NO_x$ compounds, the flame jet velocity has two further effects.

First, the flame jet, before it reaches the end of the firing chamber, is cooled down so far that the partially melted ash portions inside the flame solidify and reach the end of the firing chamber as dry dust, as a result of which the firing chamber remains clean.

Second, owing to the injector effect of the flame jet a high velocity of recirculation and hence velocity of the hot gases is obtained along the walls of the firing chamber. The latter, in addition to heat transfer owing to flame and gas radiation, bring about a heat transfer owing to convection which is already in the order of magnitude of the heat-flux density of the flame radiation. Thus the process pursuant to the invention transfers more heat into the firing chamber than do other firing processes or devices. This is one of the bases of the savings in boiler constructions costs secured by the process pursuant to the invention.

An additional commercially significant advantage of the process for practical boiler operation is that in the firing chamber heat transfer by radiation and convection adds up in such a way that a very uniform distribution of the heat-flux density is obtained on the heated surfaces. In individual cases measurements have shown that the distribution of the heat-flux density over the heat surfaces is so uniform that maximum and minimum distributions deviate less than 10% from the average value. It has further been found that the narrow flame and the high proportion of convective heat transfer cause usual peak heat-flux density values to be reduced by 20% to 30%, resulting in a longer service life of the boiler surface and lower water and steam quality requirements.

The aforementioned savings and operating advantages are likewise objects of the invention.

At discharge from the firing chamber the ash is present in the form of an exceedingly surface-active dust which has the $SO_3$ quite extensively and the $SO_2$ 60% to 70% tied up. Thus the level of $SO_2$ in the waste gas is in most cases still below the $SO_2$ level of EL fuel oil. This means that such a coal-fired plant may, from the viewpoint of $SO_2$ emission, be put up almost anywhere the operation of light oil-fired home heating systems is permitted, provided the other conditions are met. This latter feature is of great importance, and in some cases may be crucial for both economy and the conservation of energy. Herein lies one of the essential improvements of the invention with respect to the present state of the art.

In terms of design, this results in the possibility of managing with a lower stack height than in the case of higher $NO_x$ and $SO_2$ levels. Since the design of a power plant today quite frequently starts with stack appraisal and tall stacks are not universally approved, the process pursuant to the invention in many cases offers the only or only economical possibility for erecting power plants at certain locations.

Guidelines for the structural design of the arrangement follow from the process requirements.

An example for design pursuant to the invention of the arrangement for accomplishment of that part of the process pursuant to the invention concerning the firing operation itself has already been given above. Additional conditions for design of the firing chamber follow from the process pursuant to the invention.

Essential to the invention is the maintenance of certain heating and cooling rates, which at given flow rates must be proportionally characteristic measurements.

The firing chamber loads and flame jet velocities, and hence all characteristic through-put rates, are limited by the reactivity of the fuel. The said rates are characterized by upper limiting values of the flame jet velocity of approximately 200 m/sec. For reasons of safety an allowance is made and flame jet velocities of 140–180 m/sec. are selected as upper limits in practice. The upper limits of the through-put rates are thereby fixed. The highest permissible firing chamber measurements, and hence the highest permissible exchangeable quantities of heat per firing chamber, then follow from these heating and cooling rates. The latter amount from the above figures to about $30\times10^6$ kcal/hr per firing chamber. It follows from this that the firing chamber of a large power plant boiler must be divided up into about 20 to 40 individual segments, which are essentially surrounded by cooled, albeit not necessarily gas-tight walls.

This results in a considerable savings of structural volume of the boiler, and assuming that the flow patterns in firing arrangement and firing chamber do not depend upon the Reynolds number—which is the case here—the sum of the volume of all individual segments is inversely proportional to the characteristic dimensions of such a segment.

This means, for example, that with sectioning of a large firing chamber into four individual firing chambers of geometrically similar design and with otherwise like conditions, temperature, rate, etc., the total space requirement is cut by one-half. With sectioning of the large firing chamber of a power plant boiler into 20 to 40 individual segments the structural volume of the firing chamber is reduced to about 20% of the hitherto existing sizes.

This savings in structural volume, which is markedly greater, for instance, than the savings in volume sought by vortex-layer firing, is likewise an essential object of the invention.

Below are described detailed examples pursuant to the invention for the arrangement for accomplishment of the process, taken with reference to the appended figures, wherein.

Figure 1:
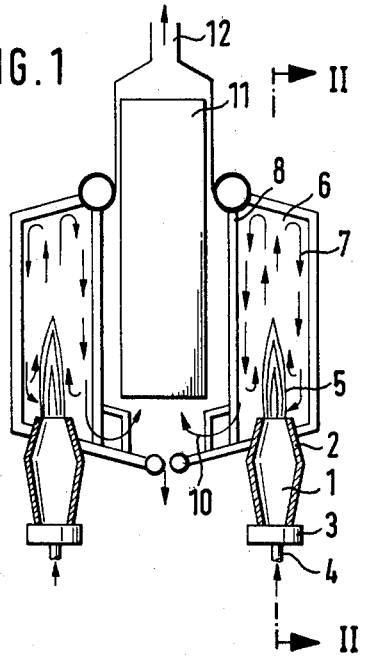
FIG. 1 shows a longitudinal view through a firing chamber arrangement.
Figure 2:
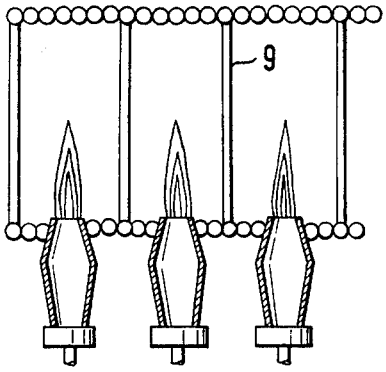
FIG. 2 shows a cross-sectional view of a plurality of firing chambers.

FIGS. 1 and 2 show longitudinal and cross-sections through an arrangement which is suitable rather for the middle range of capacity such as industrial power plants and ships. The firing arrangement consists of the divergent burner muffle 1, which becomes the accelerating nozzle 2 for the flame gases. The combustion air is supplied tangentially by way of a radial guide arrangement 3, the fuel axially or centrally by way of injection pipes 4. Obtained therein is a flame jet 5, which fills up the burner muffle almost completely to a cold-air layer near the wall, the flame jet 5 having a velocity of 100–200 m/sec. The flame jet 5 produces a return flow 7 of 60–100 m/sec. velocity in the firing chamber 6 in its outer region, resulting in the aforementioned additional convective heat transfer. The individual firing chambers are formed by cooled outside walls 8 and likewise cooled intermediate walls 9. The cooled waste gases leave the firing chambers through discharge passages 10, together with the ash in the form of dust. This effluent flows across the convection unit 11, not shown further in detail here, to the stack 12.

FIG. 2 shows a section through the individual firing chambers with the cooled side walls 9 lying between them.

Figure 3:
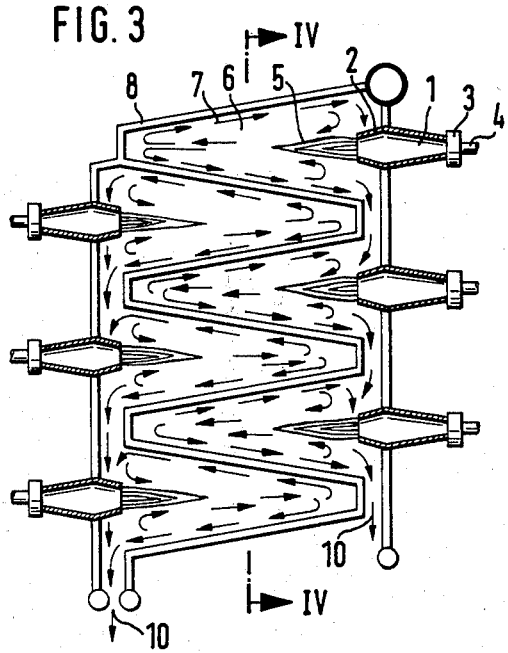
FIG. 3 shows a series of horizontal firing chambers.

FIG. 3 shows the application of the process pursuant to the invention in an embodiment which is suitable above all for large power plants. The flame 5 is now injected horizontally into firing chambers 6 arranged horizontally and here produces the likewise chiefly horizontal return flow 7.

The firing chambers 6 are formed by slightly obliquely inclined cooled walls 8 and likewise cooled vertical intermediate walls 9. The cooled waste gases leave the firing chamber system together with the dust-like ash through discharge passages 10. The subsequently added convection unit 11 is here omitted.

Figure 4:
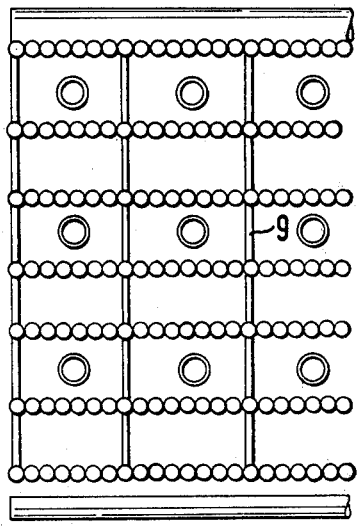
FIG. 4 shows a cross-sectional view of FIG. 3.

FIG. 4 shows a cross-section through the same arrangement. The slightly obliquely inclined cooled walls 8 and the vertical intermediate walls 9 may be recognized.

Headers and drums are drawn in simplified fashion in the figures.

The arrangements portrayed are to be regarded as examples for the application of the inventive idea. The designer is free, within the scope of the respective rules of the art, with regard to the special layout and reciprocal arrangement of the individual firing chambers, as well as with regard to coordination of the convection bank.

In FIGS. 1 to 4 burner muffle 1 and accelerating nozzle 2 are likewise cooled, but are represented in simplified fashion.

The arrangements pursuant to the invention may be fired with gaseous and/or liquid fuels, with like capacity and like efficiency. Operation is likewise possible with mixtures of gaseous, liquid and dust-like fuels in any mixture ratio.

Other modifications, variations, substitutions and omissions will be apparent to those skilled in the art.

What is claimed is:

1. The process for operating a coal-fixed power plant in environmentally sound fashion by reduction of the emission of $NO_x$ and $SO_2$, said power plant being provided with a boiler structure having at least one firing chamber, said at least one chamber having cooled walls and a burner muffle and an accelerating nozzle, and means for firing said chamber with a coal dust fuel whereby said fuel is heated rapidly before being mixed with combustion air and is rapidly cooled by said walls before being discharged, the steps comprising: preparing a coal dust fuel having a surface-active ash, injecting said fuel into the return flow of a flame in said burner muffle, said firing chamber having a load of $5–15\times10^6$ kcal/m$^3$ hr, heating said coal dust at a rate of at least 1000° C./sec. to a temperature above the ignition point of the coal dust with combustion air at an intensity such that a firing-chamber load of $5–15\times10^6$ kcal/m$^3$ hr with respect to said burner muffle and said accelerating nozzle is obtained, producing a flame jet in the accelerating nozzle at a velocity of at least 100 m/sec., cooling the flame jet by intermixture with cooled flame gases from the firing chamber in less than 0.1 sec. to less than 1000° C. gas temperature, and discharging the cooled flame gases with at least part of the ash in the form of dust from the firing chamber.

2. The process of claim 1, wherein said coal dust is a mixture of commercially available brown coal dust, and fine anthracite dust under 20-micron particle size.

3. The process of claim 1, or claim 2, wherein said coal dust is a mixture of more than 70% brown coal dust and less than 30% anthracite dust.

4. The process of claim 3, wherein, selection of the injector action of the flame jet and the dimensions of the firing chamber along the walls thereof results in gas velocities of more than 40 m/sec.

* * * * *